US009024762B2

(12) United States Patent
Rasband et al.

(10) Patent No.: US 9,024,762 B2
(45) Date of Patent: May 5, 2015

(54) PORTABLE DEACTIVATOR FOR SECURITY TAG DEACTIVATION

(71) Applicant: Sensormatic Electronics, LLC, Boca Raton, FL (US)

(72) Inventors: Paul Brent Rasband, Lantana, FL (US); Nancy Lee Van Nest, Delray Beach, FL (US); Stewart E. Hall, Wellington, FL (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 0 days.

(21) Appl. No.: 13/749,295

(22) Filed: Jan. 24, 2013

(65) Prior Publication Data

US 2014/0203936 A1 Jul. 24, 2014

(51) Int. Cl.
*G08B 13/14* (2006.01)
*G08B 13/24* (2006.01)

(52) U.S. Cl.
CPC ..... *G08B 13/2465* (2013.01)

(58) Field of Classification Search
CPC ..... G08B 13/2411; G08B 13/242; G08B 13/2425; G07G 1/0081
USPC ..... 340/572.5, 571, 572.1, 568.1, 572.4, 340/572.8, 572.9; 235/462.13, 375, 385
See application file for complete search history.

(56) References Cited

U.S. PATENT DOCUMENTS

| | | | | |
|---|---|---|---|---|
| 5,942,978 | A | 8/1999 | Shafer | |
| 6,102,290 | A * | 8/2000 | Swartz et al. | 235/462.01 |
| 6,286,762 | B1 * | 9/2001 | Reynolds et al. | 235/472.01 |
| 6,788,205 | B1 | 9/2004 | Mason et al. | |
| 7,051,943 | B2 * | 5/2006 | Leone et al. | 235/462.45 |
| 8,439,263 | B2 * | 5/2013 | Clark et al. | 235/462.01 |

* cited by examiner

*Primary Examiner* — Toan N Pham
(74) *Attorney, Agent, or Firm* — Alan M. Weisberg; Christopher & Weisberg, P.A.

(57) ABSTRACT

A portable deactivator having a corresponding identifier is provided. Identification data associated with a user is captured by the portable deactivator. A determination is made whether to activate a deactivation element in the portable deactivator based at least in part on the captured user identification data. The deactivation element is configured to disable at least one electronic article surveillance, EAS, tag when the deactivation element is activated. The deactivation element remains disabled when the determination is made the user associated with the captured identification data is unauthorized to use the deactivator.

18 Claims, 6 Drawing Sheets

PORTABLE DEACTIVATOR FOR SECURITY TAG DEACTIVATION

CROSS-REFERENCE TO RELATED APPLICATION n/a

STATEMENT REGARDING FEDERALLY SPONSORED RESEARCH OR DEVELOPMENT n/a

FIELD OF THE INVENTION

The present invention relates to security tag deactivation, and in particular to controlling the functionality of a portable security tag deactivator.

BACKGROUND OF THE INVENTION

Retail stores are often looking for ways to improve a customer's shopping experience by changing or optimizing certain retail practices. One such retail practice is associated with sale finalization, which may not only enhance a customer's shopping experience but also increase overall sales. Sale finalization generally relates to the process of completing a sale of one or more items at a point of sale (POS) terminal in which the POS terminal is typically fixed near a store exit and equipped with a tag deactivator for disabling security tags, e.g., acousto-magnetic (AM), electronic article surveillance ("EAS") tags, associated with a purchased item. The tag deactivator is often built-in to the POS terminal or attached to the POS terminal using a cable.

While sale finalization is straight forward in concept, optimizing sales finalization is an often recurring problem on retail store floors. Sale finalization at fixed POS terminals often suffers at times when sale finalization should be maximized, e.g., when there is a large influx of customers over a relatively short period of time. For example, a customer may walk around a retail store floor browsing items and select some of these items for purchase. However, the customer may end up waiting in line at a point of sale (POS) terminal for five, ten or even twenty minutes to purchase the selected items, not to mention the time it takes to locate and walk to the POS terminal. Greater wait time often results in increased customer dissatisfaction and may even cause the customer to abandon a shopping cart of selected items in order to avoiding having to wait in line.

In order to help address the problem of poor sales optimization, some retail stores have implemented mobile POS terminals, which allows customers to checkout from almost anywhere on the sales floor. In particular, a mobile POS terminal may be a handheld device such as a tablet computer carried by a store associate that enables the associate to charge the customer for items. The mobile POS terminal creates an invoice of the checkout transaction, charge payment, e.g., using the customer's credit card, generate a receipt, e.g., electronic receipt, and send details of the sale to the store's backend system for processing, e.g., updating the store's sales totals and inventory database. Mobile POS terminals are not only less complex to implement than fixed POS terminals but may be dynamically deployed throughout the store depending on fluctuations of customer traffic. For example, every employee in the store may be able to operate a respective mobile POS terminal such that customers can checkout from anywhere in the store where an employee is located, i.e., each employee with the handheld device becomes a mobile POS terminal. The mobile POS terminal scheme enhances sales finalization while helping to increase customer satisfaction.

While mobile POS terminals provide many benefits, these terminals are not without faults. In particular, a mobile POS terminal often requires the use of a tag deactivator to disable security tags of the items being purchased. The tag deactivator is an essential checkout tool used at a POS terminal to deactivate security tags associated with a purchased item. However, the added mobility of a mobile POS terminal and an associated tag deactivator makes the tag deactivator more vulnerable to misuse, and may end up causing the retail store a substantial amount in lost inventory and profits. For example, a tag deactivator located away from a fixed POS terminal increases the accessibility of the deactivator to mobile POS terminals but also to unauthorized users such as thieves.

Moreover, while having a deactivator locked to a secure location, built-in to a fixed POS terminal or attached with a cable to the fixed POS terminal to prevent unauthorized use of the deactivator, these security measures inhibit the mobility of tag deactivators as a mobile POS terminal will have to be located near the tag deactivator in order to deactivate tags for checkout. In other words, while retail stores may take steps to secure tag deactivators, the steps may end up reducing the effectiveness of mobile POS terminals.

SUMMARY OF THE INVENTION

The present invention advantageously provides a method and system for controlling portable deactivator functionality. In accordance with one aspect, a portable deactivator having a corresponding identifier is provided. The deactivator includes a deactivation element. The deactivation element is configured to change the activation state of at least one electronic article surveillance, EAS, tag. The deactivator also includes a capture element configured to receive identification data associated with a user. The deactivator also includes a processor configured to determine whether to activate the deactivation element based at least in part on whether the user associated with the received identification data is authorized to use the deactivator. The deactivation element remains disabled when the user associated with the received identification data is unauthorized to use the deactivator.

In accordance with another aspect, a system for changing the activation state of a security tag. The system includes a portable deactivator having a corresponding identifier in which the deactivator includes a deactivation element. The deactivation element is configured to change an activation state of an electronic article surveillance, EAS, tag. The deactivator also includes a capture element configured to receive identification data associated with a user. The deactivator also includes a first processor configured to determine whether a user associated with the received identification data is authorized to use the deactivator. The first processor is also configured to activate the deactivation element when the determination is made the user associated with the received identification data is authorized to use the deactivator. The deactivation element remains disabled when the determination is made the user associated with the received identification data is unauthorized to use the deactivator.

In accordance with another aspect, a method for changing a functional state of a portable deactivator having a corresponding identifier. Identification data associated with a user is captured. A determination is made whether to activate a deactivation element based at least in part on the captured user identification data. The deactivation element is configured to disable at least one electronic article surveillance, EAS, tag when the deactivation element is activated. The deactivation element remains disabled when the determination is made the user associated with the captured identification data is unauthorized to use the deactivator.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
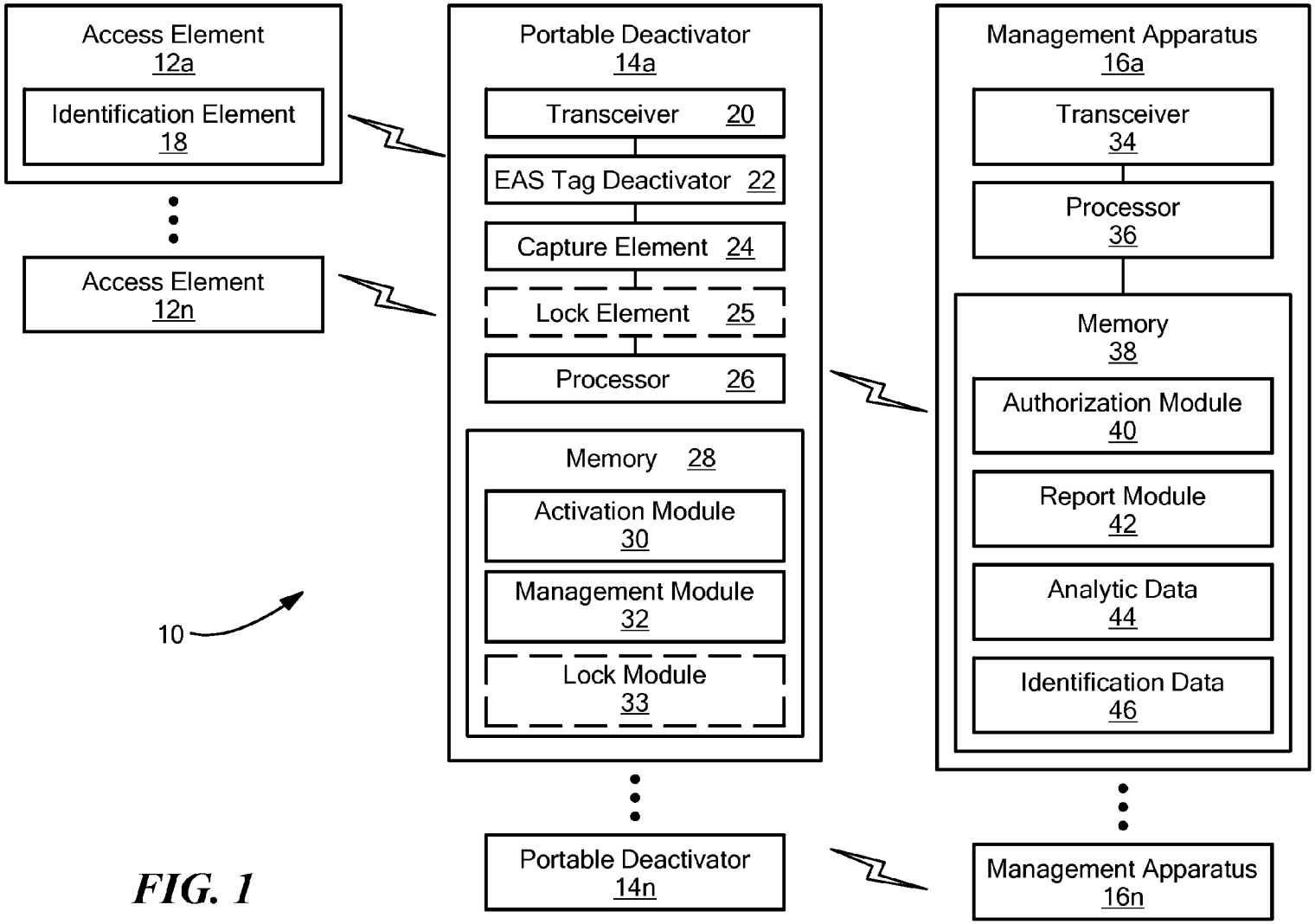
FIG. 1 is a block diagram of an exemplary system for controlling portable deactivator functionality in accordance with the principles of the present invention.

Before describing in detail exemplary embodiments that are in accordance with the present invention, it is noted that the embodiments reside primarily in combinations of apparatus components and processing steps related to implementing a system, device and method for controlling the functionality of a portable deactivator having a tag deactivation element. Accordingly, the system, device and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

As used herein, relational terms, such as "first" and "second," "top" and "bottom," and the like, may be used solely to distinguish one entity or element from another entity or element without necessarily requiring or implying any physical or logical relationship or order between such entities or elements.

Referring now to the drawing figures in which like reference designators refer to like elements there is shown in FIG. 1 an exemplary system for controlling portable deactivator functionality constructed in accordance with the principles of the present invention and designated generally as "10." System 10 includes one or more access elements 12*a* to 12*n* (collectively referred to as "access element 12"), one or more portable deactivators or devices 14*a* to 14*n* (collectively referred to as "portable deactivator 14") and one or more management apparatuses 16*a* to 16*n* (collectively referred to as "management apparatus 16"). Access element 12 and portable deactivator 14 may communicate with each other using electromagnetic based signals and protocols such as those used in radio frequency identification (RFID), near field communication (NFC), and BLUETOOTH communications or others known in the art. Portable deactivator 14 and management apparatus 16 may communicate with each other via one or more networks such as a local area network, wireless local area network, wide area network, wireless sensor network and metropolitan area network, among other networks known in the art. In particular, portable deactivator 14 may be a node in wireless sensor network that communicates with management apparatus 16 via a gateway wireless sensor node (not shown).

Access element 12 may be an active or passive element that is configured to communicate information stored in memory (not shown). For example, access element 12 may be an RFID transponder, key fob device, BLUETOOTH module or magnetic card, among other active and/or passive elements that communicate data stored in access element 12 memory. The information may include an identifier associated with one or more employees, among other information that may be used to identify a user of access element 12. For example, the identifier may be an employee identification number and/or name.

Portable deactivator 14 may include transceiver 20, EAS tag deactivator 22, capture element 24, locking element 25, processor 26 and memory 28, among other software and/or hardware components. Transceiver 20 communicates data with management apparatus 16, access element 12 and/or other devices using communication protocols known in the art. Although portable deactivator 14 is shown as including a transceiver, the invention is not limited to such. It is contemplated that a separate transmitter and a separate receiver can be used. EAS tag deactivator 22 is configured to change the activation state of a security tag such as to activate or deactivate the security tag. For example, if an acousto-magnetic EAS security tag is used, EAS tag deactivator 22 may send out a distinct high-energy pulse to deactivate the tag. For a passive RFID tag with EAS functionality, EAS tag deactivator 22 would cause one or more bits to be written to the tag in order to convert the tag's status such that the tag will not trigger an alarm when within proximity or field of view of an alarming system (e.g., EAS pedestals). For example, the tag status may be converted to one of a "sold item", "item with EAS function OFF" or other designation known in the art that will prevent the tag from triggering an alarm. One of ordinary skill in the art will recognize that other types of security tags, e.g., swept RF EAS tags, printed digital logic tags, etc., with corresponding EAS functionality, could also be used in system 10 and deactivated by EAS tag deactivator 22. The deactivation of a security tag may be verified by portable deactivator 14 by detecting a specific response from the tag just prior to deactivation or by a lack of post deactivation response.

Although an embodiment is described with respect to activation of a portable security tag deactivator 14, the invention is not limited to such. It is also contemplated that the principles of the invention may be applied to allow activation/deactivation of other devices, such as those that relate a mobile POS. For example, the functionality described herein may be used activate a mobile POS, e.g., tablet computer, and/or fixed POS, and may also be based on the activation state of security tag deactivator 14.

Capture element 24 may include an RFID module, NFC module, Zigbee module and/or biometric reader, among other element that may capture identification data from access element 12. Locking element 25 may be configured to mate with a lock component (not shown) fixed to a surface such that portable deactivator 14 may be substantially prevented from being removed from the lock component and/or moving beyond a predetermined distance from the lock component when the portable deactivator 14 is locked to the lock component.

Processor 26 may be one or more central processing units (CPUs) for executing computer program instructions stored in memory 28, as is well known in the art. Memory 28 may include non-volatile and volatile memory. For example, non-volatile memory may include a hard drive, memory stick, flash memory and others known in the art. While volatile memory may include random access memory and others known in the art. Memory 28 may store activation module 30, management module 32, lock module 33 and/or other modules and information. Activation module 30 includes instructions, which when executed by processor 26, causes processor 26 to perform the activation process discussed in detail with respect to FIG. 2 that allows the security tag deactivator device 14 to be activated for use to deactivate security tags. Management module 32 includes instructions, which when executed by processor 26, causes processor 26 to perform the management processor discussed in detail with respect to FIG. 3. Locking module 33 includes instructions, which when executed by processor 26, causes processor 26 to perform the locking/unlocking process discussed in detail with respect to FIG. 8.

Management apparatus 16 may include transceiver 34, processor 36 and memory 38, among other software and hardware components. Transceiver 34, processor 36 and memory 38 may function substantially the same as corresponding portable deactivator 14 components, with size and performance being adjusted based on design needs. Memory 38 may store authorization module 40, report module 42, analytics data 44 and identification data 46, among other modules and/or data. Authorization module 40 includes instructions, which when executed by processor 36, causes processor 36 to perform the authorization process discussed in detail with respect to FIG. 4. Report module 42 includes instructions, which when executed by processor 36, causes processor 36 to perform the reporting process discussed in detail with respect to FIG. 5.

Analytics data 44 may include data associated with the use of portable deactivator 14, i.e., portable deactivator 14 activity. For example, analytics data 44 may include an amount of tag deactivations, deactivated tag identifiers, an amount of time between portable deactivator 14 activations, items associated with deactivated tags, rate of deactivations, number of times a specific portable deactivator 14 has been activated, employee identifier and time of deactivations, among other data related to the use of portable deactivator 14. Identification data 46 may include employee identifiers, portable deactivator identifiers, employee work schedule and/or employees authorized to use portable deactivator, among other data relating to the identity and/or authorization of a user. Management apparatus 16 may be located onsite where portable deactivator is located such as in the store. Alternatively, management apparatus 16 implemented in a distributed architecture such that software applications and/or stored data may are implemented in several computing devices, i.e., servers, or in a cloud computing environment. In another alternative, management apparatus 16 may be a portable computer, table or smartphone associated with or for use by an employee or store manager. For example, management apparatus may be a mobile point of sale (POS) terminal.

Figure 2:
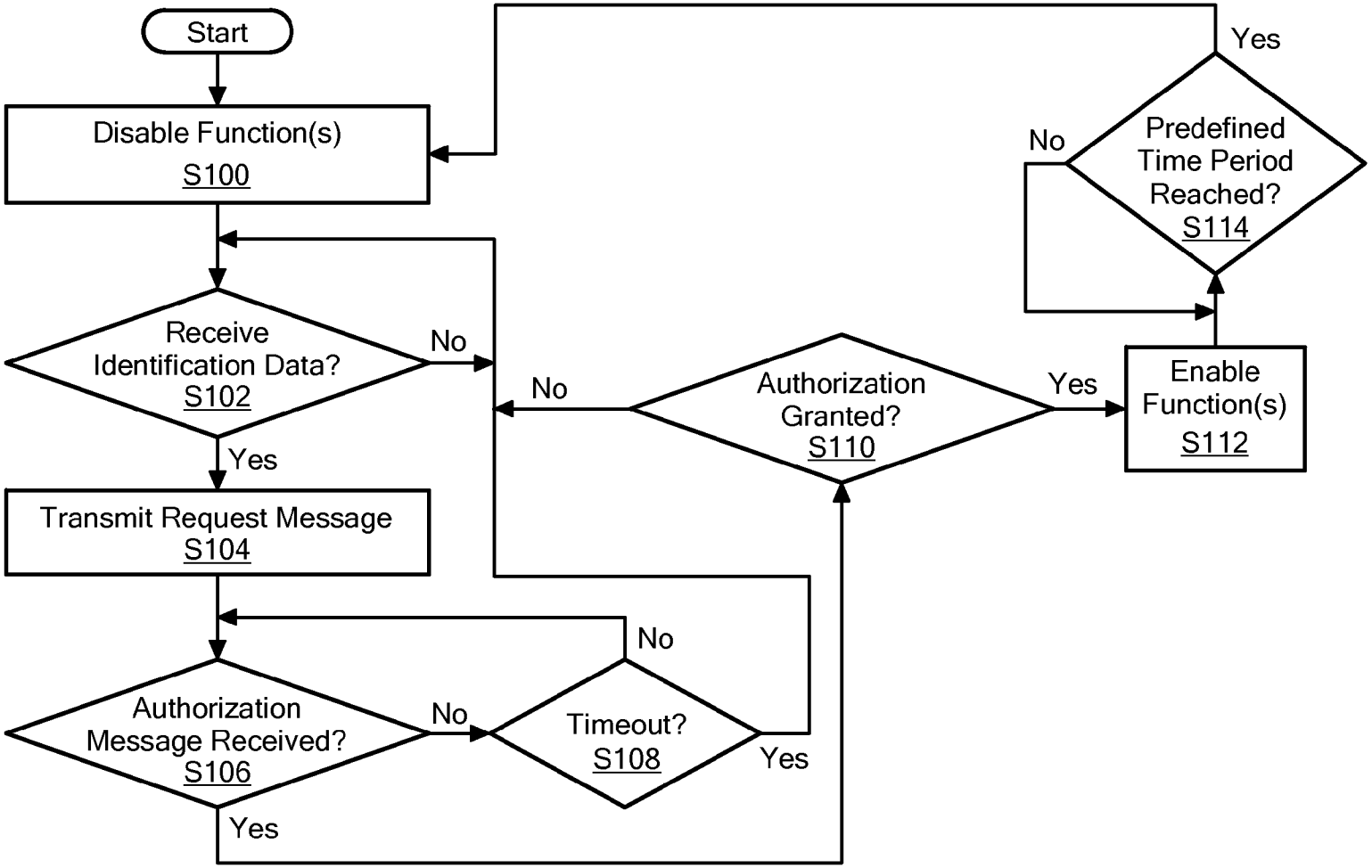
FIG. 2 is a flow chart of an exemplary process for activating functions of a portable deactivator, in accordance with the principles of the present invention.

An exemplary process for activating functions of portable deactivator 15 is described with reference to FIG. 2. Processor 26 disables portable deactivator 14 functionality (Block S100). For example, EAS tag deactivator 22 functions may be disabled, among other functions. After power on and disablement of portable deactivator 14 functionality, processor 26 determines whether identification data associated with one or more users has been captured (Block S102). In particular, capture element 24 is configured to capture identification data such as an employee identifier or tag identifier, from identification element 18. In one embodiment, capture element 24 includes an RFID reader and identification element 18 includes an RFID tag in which the RFID reader is configured to the read RFID tag for stored identification data associated with at least one user. In another embodiment, capture element 24 includes an NFC reader and identification element 18 includes an NFC tag in which the NFC reader is configured to read the NFC tag for stored identifier information associated with at least one user. The NFC reader may be built into portable deactivator 14, i.e., the NFC reader is built into a mobile phone, tablet, etc. Other capture elements 24 may include ZigBee based reader, biometric reader and/or camera. In the case of a biometric reader, the identification data may be captured from a user's fingerprint or other human characteristics that are measurable by biometric reader that may be used to identify a human. Alternatively, portable deactivator 14 may include a plurality of readers such that identification data associated with at least one user may be captured from various tag types.

If no data is captured or received, the determination of Block S102 is repeated. However, if the determination is made that identification data associated with at least one user has been captured, portable deactivator 14 transmits a request message to management apparatus 16 requesting authorization to activate portable deactivator 14 functionality (Block S104). The request message is used to request authorization to actuate or activate EAS tag deactivator 22 such that a user may use portable deactivator 14 to deactivate one or more security tags. The request message may include the captured identification data, time when the identification data was captured (i.e., time of user request) and identifier of portable deactivator 14 transmitting the request message, among other data relating to user authorization and/or activation of portable deactivator functionality. The captured identification data may include an identifier associated with one or more employees such as numeric, alpha or alpha-numeric characters, e.g., employee identifier number or access element 12 identifier associated with one or more employees.

After transmitting the request message to management apparatus 16, processor 26 determines whether an authorization message has been received (Block S106). The received authorization message indicates whether the user associated with the captured identification data is authorized to use portable deactivator 14. If the determination is made that an authorization message has not been received, processor 26 determines whether a predefined time for waiting for the authorization message has been reached, i.e., whether timeout occurred (Block S108). If the predefined time for waiting for the authorization message has been reached or time out has occurred, processor 26 performs the determination of Block S102, i.e., initiates the activation processor. In one embodiment, the predetermined time for waiting for the authorization message may be set by a management employee or other authorized user.

If the predefined time for waiting for the authorization message has not been reached, the determination of Block S106 is repeated. If the determination is made that an authorization message has been received, processor 26 determines whether authorization to use portable deactivator 14 has been granted based at least in part on the received authorization message, i.e., the authorization message indicates use is authorized or unauthorized, and may include other information such as a time portable deactivator 14 will remain activated (Block S110). If the determination is made that authorization has been granted, one or more portable deactivator functions may be activated for a predefined time period or interval, i.e., enable one or more portable device 14 functions that were deactivated in Block S100 (Block S112). For example, EAS tag deactivator 22 may be activated such that an employee at a mobile POS site may deactivate one or more security tags associated with one or more items to be purchased. Other portable deactivator 14 functionality may also be activated such as a security tag reader, scanner or other function.

After activating or enabling one or more portable deactivator functions in Block 112, processor 26 determines whether one or more portable device functions have been active or enabled for the predefined time period (Block S114). If the determination is made portable device functions have been active for the predefined time period, processor 26 disables the previously activated portable deactivator functions, i.e., returns to Block S100. If the determination is made that the predefined time period has not been reached, processor 26 repeats Block S114 such that portable device 14 functionality remains active. Moreover, portable deactivator 14 functionality may be disabled before the predefined amount of time is reached based on a sensor (not shown) that is configured to detect non-use situations such as a user putting down portable deactivator 14, i.e., a touch sensor detects a user is no longer touching or using portable deactivator 14. Referring back to Block S110, if authorization is not granted, processor 26 performs the determination of Block S102 such that portable deactivator function(s) remain disabled, i.e., a user will not be able to use EAS tag deactivator 22 to deactivate tags. Portable deactivator 14 may indicate to the user that authorization has been granted, denial of authorization, predefined amount of time left before automatic disablement and/or other portable deactivator 14 functions via at least one of audible and visual indication.

Referring back to Block S102, after identification data is determined to have been received, portable deactivator 14 may alternatively determine, itself, whether to grant authorization by comparing the captured identification data to data stored in memory 28, i.e., skips Blocks S104-S108 and goes to Block S110. For example, portable deactivator 14 may store analytics data 44 and/or identification data 46 in memory 28 such as employee identification information, codes and other information that allows portable deactivator 14 to determine whether a user associated with the captured identification data is authorized or unauthorized to use portable deactivator 14 without having to communicate with management apparatus 16 for authorization. The information stored in portable deactivator 14 may be updated periodically by portable deactivator 14, management apparatus 16 and/or by an authorized employee. For example, when portable deactivator 14 is not in use such as when EAS tag deactivator 22 is not activated, portable deactivator 14 may communicate with management apparatus 16 to download updated information such as an updated employee list, store hours, employee codes and/or other information stored at management apparatus 16 such as analytics data 44 and identification data 46. The download can be accomplished wirelessly, such as via an IEEE 802.11 WiFi network or BLUETOOTH link using transceiver 20, or via a wired connection such as through a USB interface that may be provided on portable deactivator 14. Of course, transceiver 20 can be a USB-based transceiver or include a USB communication section.

Figure 3:
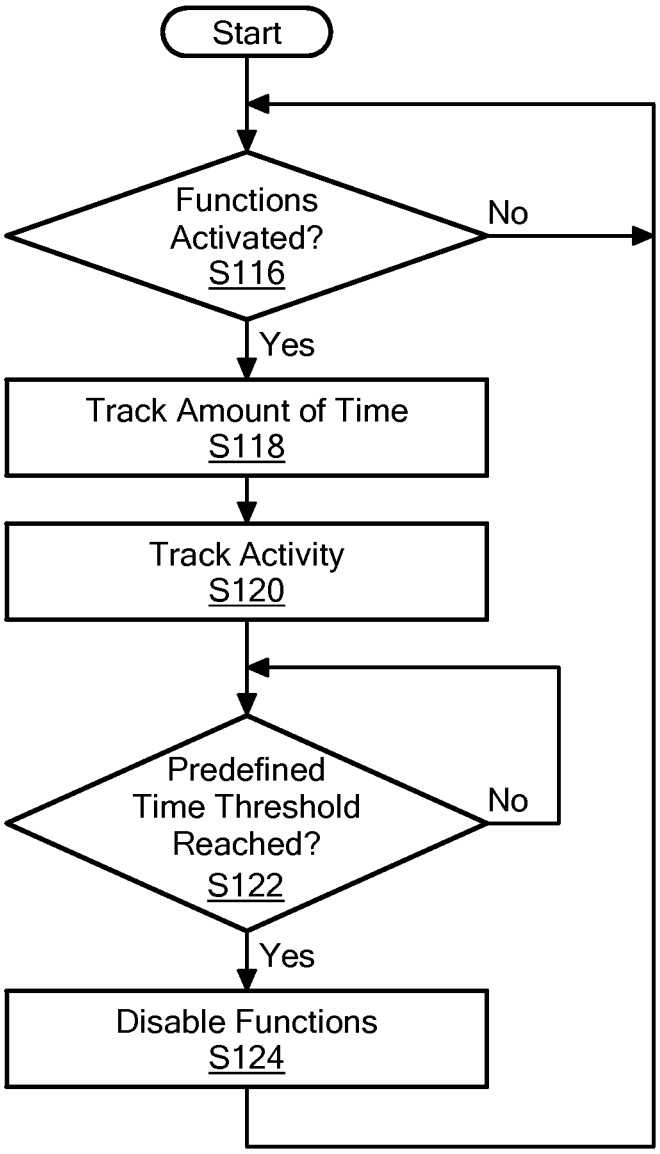
FIG. 3 is a flow chart of an exemplary process for managing portable deactivator functionality, in accordance with the principles of the present invention.

FIG. 3 illustrates an exemplary process for managing portable deactivator 14 functionality. Processor 26 determines whether portable deactivator 14 functionality or functions are activated (Block S116). For example, EAS tag deactivator 22 may have been activated as described in Block S112. If the determination is made that one or more portable deactivator 14 functions are not activated, the determination of Block S116 is repeated. If the determination is made that one or more portable deactivator 14 functions have been activated, processor 26 is configured to track an amount of time the functions remain activated (Block S118). Processor 26 is configured to track portable deactivator 14 activity (Block S120). The tracked activity may include a number of security tags deactivated, deactivated tag identifiers, item identifiers associated with the deactivated tags, time of tag deactivations and/or mobile POS station identifier where portable deactivator 14 is being used, among other activity related to portable deactivator 14 use.

Processor 26 determines whether the tracked amount of time has reached a predefined time threshold (Block S122). The predefined time threshold may correspond to a maximum amount of time portable deactivator 14 functions may remain activated after activation. For example, the predefined time threshold may correspond to five minutes or another length of time that may be predefined by a user such as a store manager or manufacturer. The predefined time threshold helps prevent unauthorized use of portable deactivator 14 by ensuring portable deactivator 14 does not remain activated after an authorized user such as an employee has finished using the device, e.g., has finished deactivating tags associated with purchased items.

If the determination is made that a predefined time threshold has not been reached, the determination of Block S122 is repeated. If the determination is made that the predefined time threshold has been reached, processor 26 disables one or more portable deactivator 14 function(s) (Block S124). For example, processor 26 may disable the previously activated EAS tag deactivator 22 and/or power down portable deactivator 14, among disable other portable deactivator 14 functionality. After disabling functions, processor 26 makes the determination of Block S116. As such, portable deactivator 14 functionality is controlled by management apparatus such that unauthorized use of portable deactivator 14 is reduced or prevented all together.

Figure 4:
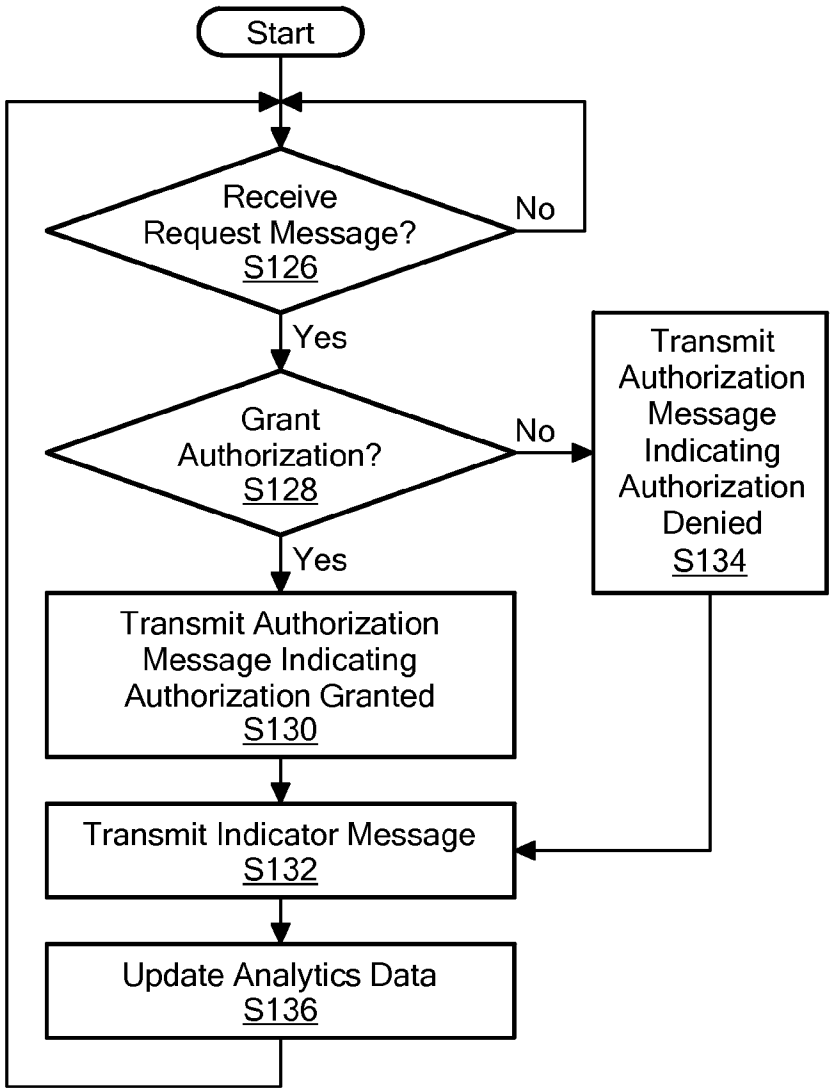
FIG. 4 is a flow chart of an exemplary authorization process for authorizing use of a portable deactivator, in accordance with the principles of the present invention.

An exemplary authorization process is described with respect to FIG. 4. Processor 36 determines whether a request message has been received, e.g., received from portable deactivator 14 (Block S126). If the determination is made that no request message has been received, the determination of Block S126 is repeated. If the determination is made that a request message has been received, processor 36 determines whether to grant authorization to use portable deactivator 14, i.e., activate portable deactivator 14 functionality (Block S128). In particular, processor 36 determines whether to grant authorization based at least in part on data included in the request message. For example, processor 36 may compare the data included in the request message such as captured identification data to identification data to determine whether a user associated with the request message is authorized to use portable deactivator 14.

For example, processor 36 may determine based at least in part on the request message that a user associated with the captured identification data 46 is a current employee or an employee scheduled to work, i.e., on duty employee, such that the user/employee is authorized to use portable deactivator 14. In another example, processor 36 uses the data included in the request message to determine the location of the portable deactivator. In one location-based embodiment, processor 36 determines the location of portable device 14 and compares an image of the person at the location with a previously recorded image of a person or employee associated with identification data captured by capture element 24. The image of the person at the location may be taken by a store video camera system (not shown) in which processor 36 correlates the location of portable deactivator 36 with one or more video cameras, i.e., video cameras with a view of portable deactivator location. The location of the portable device is determined via a node localization function in a wireless sensor network, i.e., the portable deactivator 14 includes or is attached to a wireless sensor in the wireless sensor network. The previously recorded image of the person or employee may be stored in memory 38.

If processor 36 determines the image of the person at the location meets matching criteria when compared to the previously recorded image, processor 36 may grant authorization to use portable deactivator 14. The matching criteria may include visible characteristics associated the previously recorded image such as hair color, size, skin color and/or employee uniform, among other characteristics that may be determined from an image of the employee such that the two images (from portable device 14 location and previously recorded) may be compared. Processor 36 may determine the matching criteria are met when a predefined number of characteristics between the two images match, e.g., hair color and employee uniform match. Alternatively or in addition to processor 36 determining whether a matching criteria are met, processor 36 may transmit the two images (from portable device 14 location and previously recorded) to an employee such as a manger for verification. Processor 36 may grant authorization upon verification by the manager.

In another location based embodiment where the location of portable deactivator 14 is determined, processor 36 may grant authorization when the portable device is determined to be in a predefined location. For example, one or more predefined locations or areas within a store are correlated with authorized portable deactivator 14 use such that processor 36 grants authorization based at least in part on the location of portable deactivator 14. In another alternative embodiment, the authorization may be granted by determining the captured identification data includes a valid code or identifier.

If the determination is made to grant authorization, processor 36 causes transceiver 34 to transmit an authorization message indicating authorization to use portable deactivator 14 has been granted, i.e., grants authorization to activate portable deactivator 14 functionality (Block S130). If the determination is made not to grant authorization, processor 36 causes transceiver 34 to transmit an authorization message indicating authorization is denied such that portable deactivator 14 functionality remains disabled (Block S134). For example, processor 36 may determine based at least in part on the request message that a user associated with the captured identification data is not a current employee, an off duty employee or not recognized as an employee, i.e., received unrecognized identification data, such that the user/employee is not authorized to use portable deactivator 14.

If the determination is made to grant authorization, processor 36 causes transceiver 34 to transmit an indicator message (Block S132). The indicator message may be used to indicate to the user that portable deactivator 14 functionality has been granted, i.e., a light emitting diode, display and/or other component capable of notifying the user of the granted authorization may be triggered. Analytics data 44 may be updated (Block S136). For example, the number of times the user has requested to use portable deactivator 14 may be updated and/or the time of the request may be recorded, among other data associated with the authorization. The analytics data 44 may also be updated during or after portable deactivator 14 use with activity data received from portable deactivator 14 such that tag deactivation and other data can be tracked. The updated analytics data 44 may include a correlation between authorization events associated with a particular employee and corresponding sales events by the employee. For example, analytics data 44 indicates whether security tags have been deactivated without corresponding sales receipts, i.e., sales finalization, such that an employee is deactivating security tags but failing to charge the customer for the associated items, thereby leaving the unpurchased items with deactivated security tags vulnerable to theft. Processor 36 flags such unfinalized transactions or suspicious use of portable deactivator 14 for review by security or management personnel.

Figure 5:
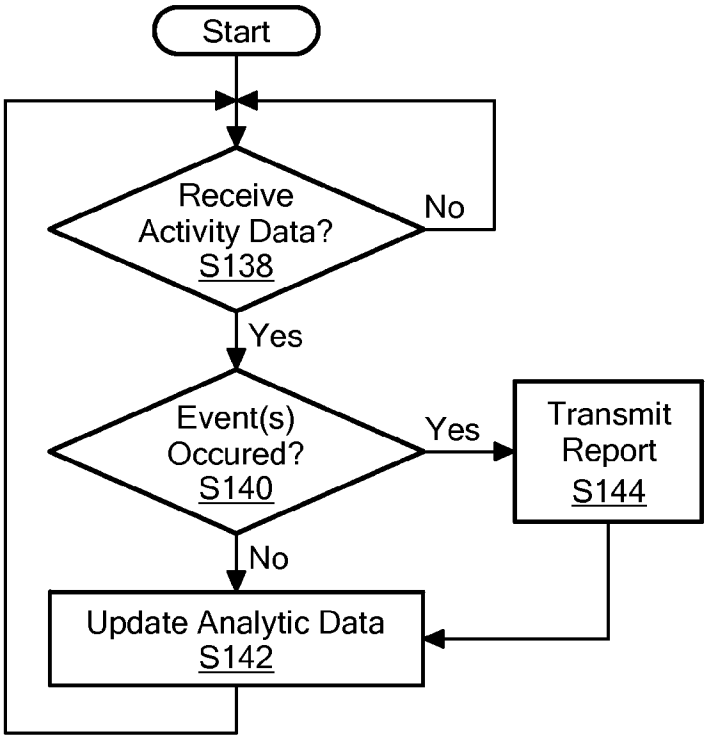
FIG. 5 is a flow chart of an exemplary reporting process for reporting portable deactivator information, in accordance with the principles of the present invention.

An exemplary reporting process is described with reference to FIG. 5. Processor 36 determines whether activity data associated with portable deactivator 14 use has been received (Block S138). If the determination is made that activity data has not been received, the determination of Block S138 is repeated. If the determination is made that activity data has been received from portable deactivator 14, processor 36 determines whether the activity data indicates one or more events has occurred (Block S140). An event may includes suspicious use of portable deactivator 14 and/or deactivation mile post(s), among events related to other portable deactivator 14 use that may be determined by applying one or more predefined rules. The deactivation mile post may be a predefined number of deactivations such as 100th or 200th tag deactivation. The deactivation mile posts provide a way to monitor the general pace or level of tag deactivations in a store in a convenient manner.

Suspicious use of portable deactivator 14 may be determined based at least in part by applying a predefined rule or rule set to activity data, analytics data 44 and/or identification data, among other data received and/or stored at management apparatus 16. Each rule defines a criteria such as a number of tag deactivations, rate of tag deactivations and/or number of tags deactivations associated with an item, among other criteria indicating suspicious use that may be predefined by an administrator and/or manufacturer. For example, a user may deactivate tags at a high rate, i.e., rate above a predefined threshold, such that suspicious use is flagged by management apparatus 16. Also, multiple tags associated with the same item may be deactivated such that management apparatus 16 will flag such activity as suspicious as it is unlikely a consumer will purchase the same item more than a predefined number of times in one visit.

If the determination is made that no event has occurred, analytics data 44 and/or other data stored in memory 38 is updated based at least in part on the received activity data (Block S142). After updating analytics data 44 and/or other data stored in memory 38, processor 36 performs the determination of Block S138. Referring back to Block S140, if the determination is made that at least one event has occurred, a report is transmitted (Block S144). The report may include information associate with one or more events such as a number of tags deactivated, time period over which the tags were deactivated, employee identification data, tag identification and/or item information associated with the deactivated tags, among other event related information that may be reported. The report may be transmitted to a person or group of people responsible for management of the store, retail enterprise or store employee(s) where portable deactivator 14 is being used. After transmitting the report, analytics data 44 is updated (Block S142). Report module allows a monitoring employee or management to be notified of events during and/or after use of portable deactivator 14.

Figure 6:
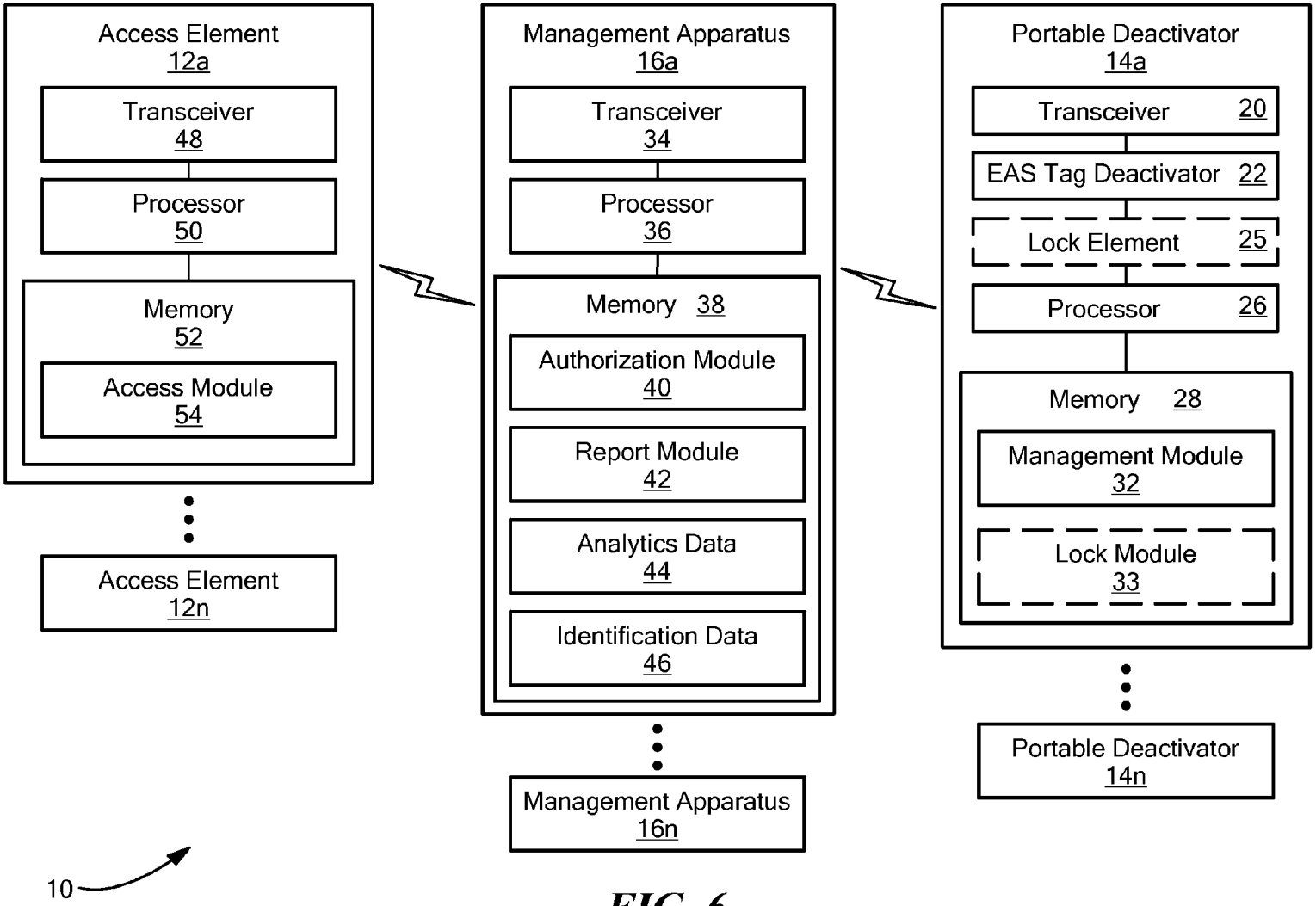
FIG. 6 a block diagram of another exemplary system for controlling portable deactivator functionality, in accordance with the principles of the present invention.

Another exemplary system 10 for controlling portable deactivator functionality constructed in accordance the principles of the present invention is discussed with reference to FIG. 6. System 10 includes access element 12, management apparatus 16, and portable deactivator 14 in which access element 12 communicates with management apparatus 16 and management apparatus 16 communicates with portable deactivator 14. Access element 12 may be a laptop, tablet, mobile device and/or transponder, among other communication device. Access element 12 may include transceiver 48, processor 50, memory 52 and access module 54. Transceiver 48, processor 50 and memory 52 may function substantially the same as corresponding portable deactivator 14 components, with size and performance being adjusted based on design needs. Memory 52 may store access module 54, among other modules and data. Access module 54 includes instructions, which when executed by processor 50, causes processor 50 to activate portable deactivator 14 for use as is discussed in detail with respect to FIG. 7.

Management apparatus 16 includes transceiver 34, processor 36, authorization module 40, report module 42, analytics data 44 and identification data 46, among other modules and data. Authorization module 40 performs the functions discussed with respect to FIG. 4, except that the request message is received from access element 12 and the indicator message may alternatively or in addition to be transmitted to access element 12 for display. Portable deactivator 14 may include transceiver 20, EAS tag deactivator 22, processor 26 and memory 28, among other software and/or hardware components. Memory 28 may include management module 32 as discussed above respect to FIG. 3.

Figure 7:
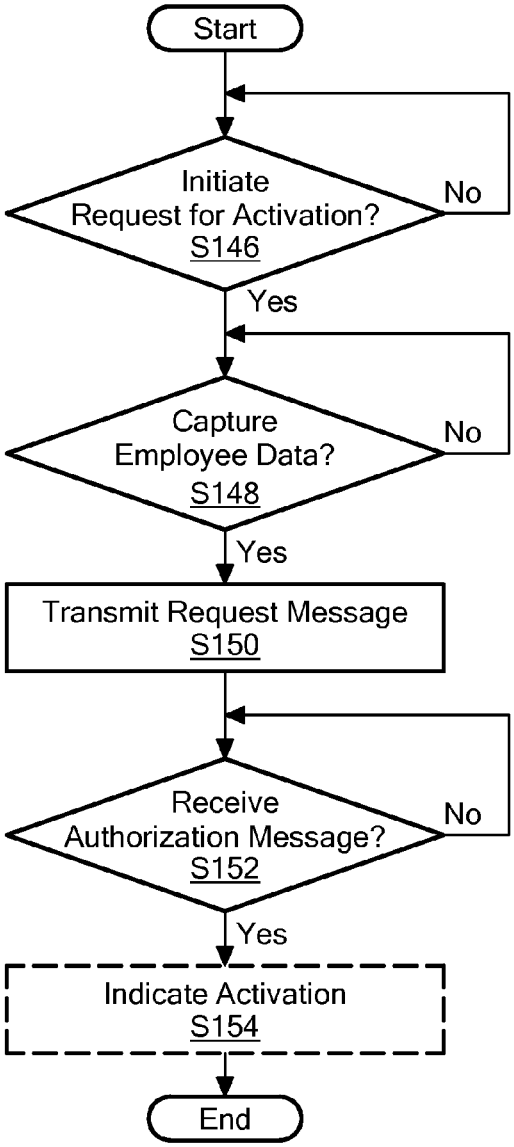
FIG. 7 is a flow chart of an exemplary process for initiating portable deactivator functionality, in accordance with the principles of the present invention.

An exemplary process for activating portable deactivator 14 for use is discussed with respect to FIG. 7. Processor 50 determines whether to initiate a request for activation of portable deactivator 14 functionality (Block S146). For example, the determination may be based on a user input via an input element such as a keyboard or button, among other input elements known in the art. If the determination is made not to initiate a request for activation, the determination of Block S146 is repeated. If the determination is made to initiate a request for activation, processor 50 determines whether employee data has been captured (Block S148). The employee data may be captured using the input device and may include one or more alpha, numeric or alpha-numeric characters that may identify an employee. The input device may include a biometric scanner for capturing characteristics associated with a user.

If the determination is made that no employee data has been captured, the determination of Block S148 is repeated. However, if the determination is made that employee data has been captured, transceiver 48 transmits a request message indicating activation of portable deactivator 14 functionality is requested (Block S150). Request message may include the captured employee data and/or time employee data was captured, among other data that is used to determine whether a user is authorized to use portable deactivator 14. After the request message has been transmitted, processor 50 determines whether an authorization message has been received (Block S152). The authorization message indicates whether authorization has been granted as discussed above with respect to Block S106. Alternatively or in addition to, the authorization message may be transmitted to portable deactivator 14. Access element 12 indicates whether authorization has been granted based on the received authorization message (Block S154). For example, access element 12 may indicate authorization has been granted, denied and/or deactivation time remaining via a display and/or audible element and/or light emitting diode, among other components. Alternatively, Block 154 may be omitted based on design need.

Figure 8:
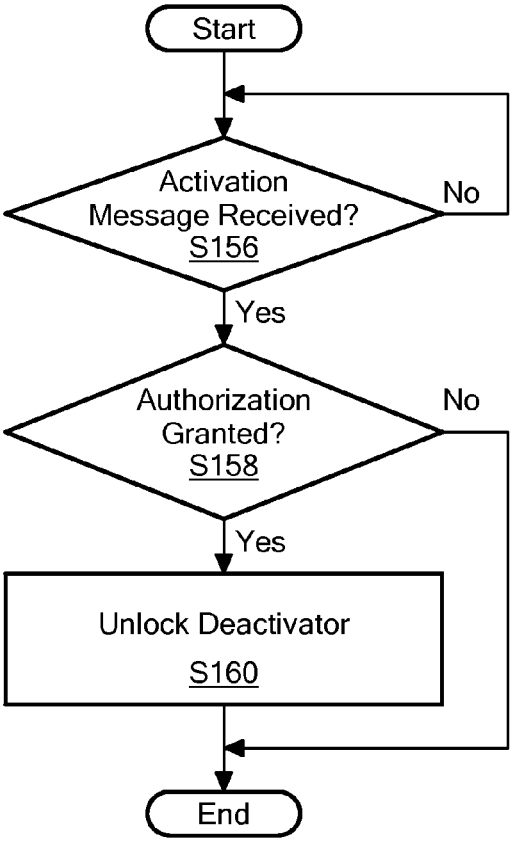
FIG. 8 is a flow chart of an exemplary locking process, in accordance with the principles of the present invention.

FIG. 8 illustrates an exemplary process for unlocking portable deactivator 14. Processor 26 determines whether an activation message has been received (Block S156). If the determination is made that an activation message has not been received, the determination of Block S156 is repeated. If the determination is made that an activation message has been received, processor 26 determines whether authorization has been granted as discussed in Block S110 (Block S158). If authorization has been denied, the locking process may end such that portable deactivator 14 remains unusable for security tag deactivation. For example, lock element 25 remains mated with the lock component such that portable deactivator 14 may be substantially prevented from moving beyond the predetermined distance. In another example, functionality of EAS tag deactivator 22 remains disabled such that portable deactivator 14 remains logically locked.

If the determination is made that authorization has been granted based at least in part on the authorization message, portable deactivator 14 is physically and/or logically unlocked such as to allow security tag deactivations (Block S160). For example, lock element 25 may be disengaged such as to allow portable deactivator 14 to be moved beyond the predetermined distance from the lock component, i.e., portable deactivator 14 is unlocked such that an authorized user at a mobile POS terminal may move portable deactivator 14 in order to conveniently process a consumer purchase. In other words, lock element 25 helps prevent unauthorized use of deactivator. In another example, portable deactivator 14 functionality may be logically unlocked, i.e., EAS tag deactivator 22 is activated, such as to allow security tag deactivation. Alternatively, portable deactivator 14 may, itself, determine that the user is authorized such that portable deactivator 14 is physically and/or logically unlocked, i.e., processor 26 compares captured identification data with data stored in memory 28 to determine whether the user associated with captured identification data is authorized to use portable deactivator 14.

The present invention can be realized in a combination of hardware and software. Any kind of computing system, or other apparatus adapted for carrying out the methods described herein, is suited to perform the functions described herein.

A typical combination of hardware and software could be a specialized or general purpose computer system having one or more processing elements and a computer program stored on a storage medium that, when loaded and executed, controls the computer system such that it carries out the methods described herein. The present invention can also be embedded in a computer program product, which comprises all the features enabling the implementation of the methods described herein, and which, when loaded in a computing system is able to carry out these methods. Storage medium refers to any volatile or non-volatile storage device.

Computer program or application in the present context means any expression, in any language, code or notation, of a set of instructions intended to cause a system having an information processing capability to perform a particular function either directly or after either or both of the following a) conversion to another language, code or notation; b) reproduction in a different material form.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A portable deactivator having a corresponding identifier, the deactivator comprising:

a deactivation element, the deactivation element configured to change an activation state of at least one electronic article surveillance, EAS, tag;

a capture element, the capture element configured to receive identification data associated with a user;

a transmitter, the transmitter configured to transmit a request message including the identifier and received identification data;

a receiver, the receiver configured to receive an authorization message, the authorization message indicating whether the user associated with the received identification data is authorized to use the deactivation element; and a processor, the processor configured to determine whether to activate the deactivation element based at least in part on whether the user associated with the received identification data is authorized to use the deactivator based at least in part on the received authorization message, the deactivation element being disabled when the user associated with the received identification data is unauthorized to use the deactivator.

2. The portable deactivator of claim 1, wherein the processor is further configured to:

track an amount of time the deactivation element remains activated; and disable the deactivation element when the amount of time reaches a predetermined threshold.

3. The portable deactivator of claim 2, wherein the processor is further configured to:

generate activity data relating to tag deactivations, the deactivation element being disabled before the predetermined threshold is reached when the activity data indicates suspicious use of the deactivation element.

4. The portable deactivator of claim 1, wherein the capture element is one of a radio frequency identification reader, near field communication reader, biometric reader and magnetic card reader.

5. A system for changing an activation state of a security tag, the system comprising:

a portable deactivator having a corresponding identifier, the deactivator including:

a deactivation element, the deactivation element configured to change the activation state of the security tag;

a capture element, the capture element configured to receive identification data associated with a user; and a first processor, the first processor configured to:

determine whether the user associated with the received identification data is authorized to use the deactivator; and activate the deactivation element when the determination is made the user associated with the received identification data is authorized to use the deactivator, the deactivation element remaining disabled when the determination is made the user associated with the received identification data is unauthorized to use the deactivator; and a management apparatus in communication with the deactivator, the management apparatus including:

a receiver, the receiver configured to receive a request message generated by the deactivator, the request message including the identifier and received identification data;

a second processor, the second processor configured to determine whether the user associated with the received identification data is authorized to use the deactivator based at least in part on the received request message;

a transmitter, the transmitter configured to transmit an authorization message indicating whether the user associated with the received identification data is authorized to use the portable deactivator; and the determination by the first processor whether the user associated with the received user identification data is authorized to use the deactivator being based at least in part on the authorization message.

6. The system of claim 5, wherein the determination by the second processor whether the user associated with the received identification data is authorized to use the deactivator is based at least in part on whether the user associated with the user identification data is on active work duty.

7. The system of claim 5, wherein the receiver is further configured to receive activity data generated by the deactivator, the activity data corresponding to tag deactivations; the second processor is further configured to determine whether the activity data indicates suspicious use of the deactivator; and the transmitter is further configured to transmit an alert message when the determination is made the activity data indicates suspicious use of the deactivator, the alert message configured to notify a second user of the suspicious use.

8. The system of claim 7, wherein the second transmitter is further configured to transmit a disablement message to the portable deactivator when the determination is made the activity data indicates suspicious use of the portable deactivator; and the first processor is further configured to disable the deactivation element based at least in part on the disablement message.

9. The system of claim 7, wherein suspicious use is defined by at least one rule, the at least one rule including one of a number of tag deactivations within a predefined period of time and a number of tag deactivations associated with a single item.

10. The system of claim 5, wherein the receiver is further configured to receive an image of the user at a location of the portable deactivator; and the determination by the second processor whether the user associated with the received identification data is authorized to use the deactivator is based at least in part on whether the received image meets a matching criteria when compared to a previously recorded image of the user, the matching criteria including at least one visible characteristics of a person.

11. The system of claim 5, wherein the second processor is further configured to determine a location of the portable deactivator; and the determination by the second processor whether the user associated with the received identification data is authorized to use the deactivator is based at least in part on location of the portable deactivator.

12. The system of claim 5, wherein the determination by the second processor whether the user is authorized to use the deactivator is based at least in part on whether the request message was received during a predetermined period of time.

13. The system of claim 5, wherein the deactivator further includes a locking element configured to restrict movement of the deactivator, the locking element being configured to allow the deactivator to be moved beyond a predetermined distance when the authorization message indicates the user associated with the receive identification data is authorized to use the deactivator.

14. A method for changing a functional state of a portable deactivator having a corresponding identifier, the method comprising:

capturing identification data associated with a user;

transmitting a request message, the request message including the identifier and the captured identification data;

receiving an authorization message in response to the transmitted request message, the authorization message indicating whether the user associated with the captured identification data is authorized to use the deactivation element;

determining whether to activate a deactivation element based at least in part on the captured user identification data and being based at least in part on the received authorization message, the deactivation element being configured to disable at least one electronic article surveillance, EAS, tag when the deactivation element is activated; and the deactivation element remaining disabled when the determination is made the user associated with the captured identification data is unauthorized to use the deactivator.

15. The method of claim 14, further comprising:

tracking an amount of time the deactivation element remains activated; and disabling the deactivation element when the amount of time reaches a predefined threshold.

16. The method of claim 15, further comprising:

generating activity data based at least in part on tag deactivations; and disabling the deactivation element before reaching the predefined threshold when the activity data indicates suspicious use of the deactivation element.

17. The method of claim 16, wherein suspicious use is defined by at least one rule, the at least one rule including one of a number of tag deactivations within a predefined period of time and a number of tag deactivations associated with a single item.

18. The method of claim 14, wherein the capturing is performed by one of a radio frequency identification reader, near field communication reader, biometric reader and magnetic card reader.

* * * * *